United States Patent [19]

Kanoi et al.

[11] 4,371,858

[45] Feb. 1, 1983

[54] STATIC INDUCTION APPARATUS

[75] Inventors: Minoru Kanoi, Tokai; Yasuro Hori, Ibaraki, both of Japan

[73] Assignee: Hitachi, Ltd., Tokyo, Japan

[21] Appl. No.: 217,772

[22] Filed: Dec. 18, 1980

[30] Foreign Application Priority Data

Dec. 18, 1979 [JP] Japan ..... 54-163476

[51] Int. Cl.[3] ..... H01F 15/00

[52] U.S. Cl. ..... 336/100; 181/202; 181/208; 188/379; 188/380

[58] Field of Search ..... 336/100; 181/202, 208, 181/204, 207, 286; 188/379, 380; 267/136, 141.1

[56] References Cited

U.S. PATENT DOCUMENTS 4,177,876 12/1979 Pujolle ..... 181/286 X

FOREIGN PATENT DOCUMENTS 240962 6/1965 Austria ..... 181/202
1112311 8/1961 Fed. Rep. of Germany ..... 181/207
1185832 1/1965 Fed. Rep. of Germany ..... 181/202
672054 10/1964 Italy ..... 336/100
826501 1/1960 United Kingdom ..... 336/100
1184619 3/1970 United Kingdom ..... 336/100

OTHER PUBLICATIONS

"Transformer Noise Abatement Using Tuned Sound Enclosures", EPRI EL529, Research Project 579-1, Allis Chalmers Corp., Oct. 1977, p. 255.

*Primary Examiner*—Thomas J. Kozma
*Attorney, Agent, or Firm*—Antonelli, Terry and Wands

[57] ABSTRACT

This invention relates to an isolator for a large-sized static induction apparatus such as transformer and reactor. The static induction apparatus wherein a sound insulation panel is mounted through an elastic body on a reinforcing channel which is disposed on a side plate of an oil tank receiving a main device of the apparatus therein, is characterized by disposing a looped weight beam near that part of the sound insulation panel on which the elastic body is installed.

With such construction, noise can be effectively reduced while imparting a satisfactory supporting strength to the mounting part of the sound insulation panel.

13 Claims, 7 Drawing Figures

STATIC INDUCTION APPARATUS

BACKGROUND OF THE INVENTION

This invention relates to a static induction apparatus such as transformer and reactor. More particularly, it relates to an isolator for reducing the amount to which the vibration of the main device of the static induction apparatus appears in the form of noise externally.

With urban developments, ordinary houses have been built near a substation etc., and the reduction of noise from static induction apparatuses which are installed on the substation etc. has been eagerly requested. Especially the noise developing in the iron core of the static induction apparatus is of high energy, and several preventive measure against the noise have heretofore been adopted.

For example, it has been known to surround the static induction apparatus with sound insulation walls by the use of concrete or iron plates. They thus become large-scaled facilities and incur increases in the installation area and the cost. It has also been known to mount a sound insulation panel on the reinforcing channel of the tank side plate of the static induction apparatus through an elastic body of rubber or the like (EPRI Report EL-529 Research Project 579-1, 2-55).

For an effective sound insulation, however, the spring constant of the elastic body supporting the sound insulation panel needs to be made very small.

The diminution of the spring constant is limited because the elastic body must be simultaneously endowed with a strength necessary for supporting the sound insulation panel. It has therefore been difficult to attain a satisfactory sound insulation effect.

SUMMARY

This invention has for its object to provide a static induction apparatus in which vibration to be transmitted from a reinforcing channel to a sound insulation panel is sharply weakened to permit an efficient reduction of noise.

The inventor analyzed and studied the vibration system of a sound insulation panel carried on the reinforcing channel of the tank side plate of a static induction apparatus through an elastic body. As a result, it has been revealed that the sound insulating effect based on the diminution of the spring constant of the elastic body has its limit, so a favorable reduction of noise is difficult. In view of this fact, it has been intended to make the effective mass $m_r^*$ of the sound insulation panel great.

At the same time, in order to prevent the weight of the whole sound insulation panel from increasing considerably, the effective mass $m_r^*$ of that portion of the sound insulation panel to which vibration is transmitted first through the elastic body has been made great.

A concrete structure is characterized in that a looped weight beam is attached near the portion of the sound insulation panel on which the elastic body is mounted or that the weight of the corresponding portion of the sound insulation panel is made greater than that of the other portion.

DETAILED DESCRIPTION OF THE PREFERRED EMBODIMENTS OF THE INVENTION

Figure 1:
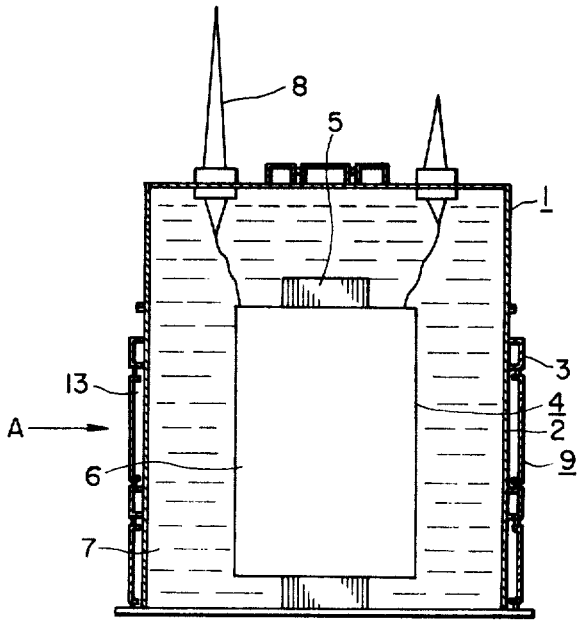
FIG. 1 is a sectional side elevation showing an embodiment of this invention.

In order to sharply reduce the vibration of a sound insulation panel carried on a reinforcing channel through an elastic body, the inventor attempted to analyze the vibration system of the sound insulation panel. Regarding the unit assembly of the sound insulation panel, the equation of motion has been set up as follows:

$$[M]\{\ddot{x}\}+[C]\{\dot{x}\}+[K]\{x\}=k\cdot y \tag{1}$$

where

[M]: mass matrix,
[C]: damping matrix,
[K]: rigidity matrix,
$\{\ddot{x}\}$: accelerator vector,
$\{\dot{x}\}$: velocity vector,
$\{x\}$: displacement vector,
k: supporting spring constant,
y: primitive translation.

By solving Equation (1), the vibration of the order r is expressed by the following equation:

$$m_r^*\ddot{q}_r+c_r^*\dot{q}_r+k_r^*q_r=\{\phi_r\}^T\cdot k\cdot y \tag{2}$$

where $m_r^*$: effective mass of order r ($=\{\phi_r\}^T[M]\{\phi_r\}$),
$c_r^*$: damping of the order r ($=\{\phi_r\}^T[C]\{\phi_r\}$),
$k_r^*$: spring constant of the order r ($=\{\phi_r\}^T[K]\{\phi_r\}$),
$\{\phi_r\}$: characteristic vector of the order r,
$q_r$: displacement of the order r in a reference frame,
$\dot{q}_r$: velocity of the order r in the reference frame ($=dq_r/dt$),
$\ddot{q}_r$: acceleration of the order r in the reference frame ($=d^2q_r/dt^2$),
$\{\phi_r\}^T$: transposed vector of the characteristic vector of the order r.

The following relation holds between $q_r$ in Equation (2) and $\{x\}$ in Equation (1):

$$\{x\} = \sum_r \{\phi_r\}\, q_r \tag{3}$$

When $q_r$ is evaluated from Equation (2) and then substituted into Equation (3), the steady response in Equation (1) is evaluated by the following equation:

$$\{x\} = \sum_r \{\phi_r\}T\left(\frac{\{\phi_r\}T_{ky}}{m^*_r}\times\frac{1}{\omega_r^2-\omega^2+j\,2\omega_r\omega\zeta}\right) \tag{4}$$

where $\omega$: exciting angular frequency (rad/s),
$\omega_r$: characteristic angular frequency of the order r (rad/s),
$\zeta$: damping ratio.

As indicated by Equation (4), to the end of weakening the vibration of the sound insulation panel to be transmitted from the reinforcing channel (foundation), there are considered the two methods of making k small and making $m_r^*$ great.

It is understood that the sound insulation panel in the prior art previously described corresponds to the case where the constant k of the supporting spring in Equation (4) is made very small so as to weaken the vibration of the sound insulation panel. The prior-art system involves the problem in practical use as stated before.

This invention consists in that, while holding the spring constant k at an appropriate value required in point of the strength of the spring, the effective mass $m_r^*$ of a suitable portion of the sound insulation panel is made great.

If all the effective masses $m_r^*$ of various parts are made great, the weight of the whole sound insulation panel becomes great, and hence, the spring constant k of the elastic body supporting the sound insulation panel must be set at a large value.

The large spring constant k signifies that the vibration is liable to be transmitted. In order to avoid this drawback, while suppressing the weight of the sound insulation panel, the effective mass $m_r^*$ of the suitable portion thereof is increased.

Since the amplitude of the vibration becomes the maximum in a part corresponding to the loop of the standing wave of the vibration, it is considered to increase the effective mass $m_r^*$ in only this part. This measure, however, results in increasing the weight of the sound insulation panel because a large number of loop positions appear on account of the occurrence of a large number of higher harmonics.

This invention has therefore increased the effective mass, not in the maximum point of the vibration, but in that part of the sound insulation panel to which the vibration is transmitted first. "That part of the sound insulation panel to which the vibration is transmitted first" is the portion of the sound insulation panel near a part on which the elastic body is mounted, and a looped weight beam has been disposed on this portion. As a result, it has become possible to render the vibration of the sound insulation panel very weak and the developing noise extremely low.

EXAMPLES

Examples of this invention will now be described with reference to the drawings.

Referring to FIG. 1, an oil tank 1 for a static induction apparatus is constructed of a side plate 2 and a plurality of reinforcing channels 3 which are fastened on the side plate 2 by welding. The oil tank 1 receives therein a main device of the static induction apparatus, 4 consisting of an iron core 5 and a winding 6, and it is filled up with insulating oil 7 intended for insulation and cooling. Further, a bushing 8 is mounted on the upper part of the oil tank 1 so as to connect the winding 6 with an external bus (not shown). A sound enclosure 9 is installed between the reinforcing channels 3.

Figure 2:
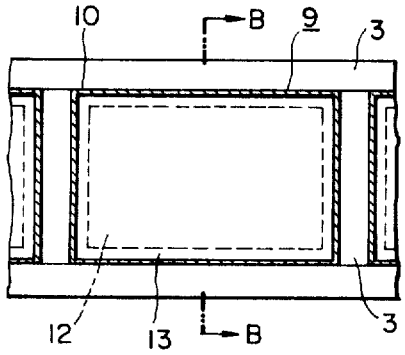
FIG. 2 is a schematic side view showing the essential construction of the embodiment.
Figure 3:
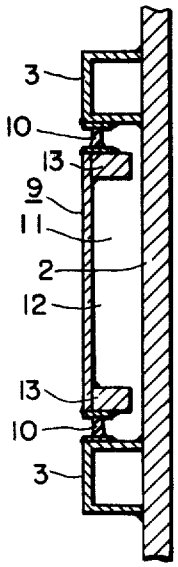
FIG. 3 is a fragmentary sectional view showing the essential construction more in detail.

Referring to FIGS. 2 and 3, the sound enclosure 9 is constructed of an insulation rubber member 10 which is fixed to the peripheral end of the reinforcing channel 3, a sound insulation panel 12 which is fixed to the end of the insulation rubber 10 remote from the reinforcing channel 3 and which is disposed so as to define a cell 11 between it and the side plate 2, and a looped weight beam 13 which is mounted on the outer peripheral edge of the inner surface of the sound insulation panel 12, that is, near a place where the insulation rubber 10 is fixed to the sound insulation panel 12. Such sound enclosures 9 are disposed in suitable places between the reinforcing channels 3 of the oil tank 1.

Now, the operation will be described. Electromagnetic vibration having developed in the iron core 5 is transmitted from the right side as viewed in FIG. 3 through the insulating oil 7 to the side plate 2. As a result, the oil tank 1 undergoes bending vibration. In general, the magnitude of the vibration is greater in the portion of the side plate 2 not provided with the reinforcing channel 3, than in the portion thereof provided with the reinforcing channel 3. Accordingly, noise which is generated from the portion of the side plate 2 not provided with the reinforcing channel 3 is louder, but most of the noise is insulated by the sound insulation panel 12. In this case it is also possible to achieve a sound absorbing effect by putting a sound absorbing material into the cell 11 as is known.

When the vibration is transmitted from the reinforcing channel 3 to the sound insulation panel 12, this sound insulation panel 12 becomes a sounding body and has the sound insulating effect thereof spoiled. The transmission of the vibration is therefore prevented by supporting the sound insulation panel 12 with, in general, an elastic body (the insulation rubber 10 in case of FIG. 3). As described before, however, the prior art needs to make the spring constant of the insulation rubber 10 considerably small and thus has been very impractical from a strength standpoint.

In contrast, in the present example, the weight beam 13 is disposed in the vicinity of that place of the sound insulation panel 12 on which the insulation rubber 10 is mounted, so that the vibration of the sound insulation panel 12 can be satisfactorily reduced even when the insulation rubber 10 having a spring constant that is practical from a strength standpoint is used.

Figure 4:
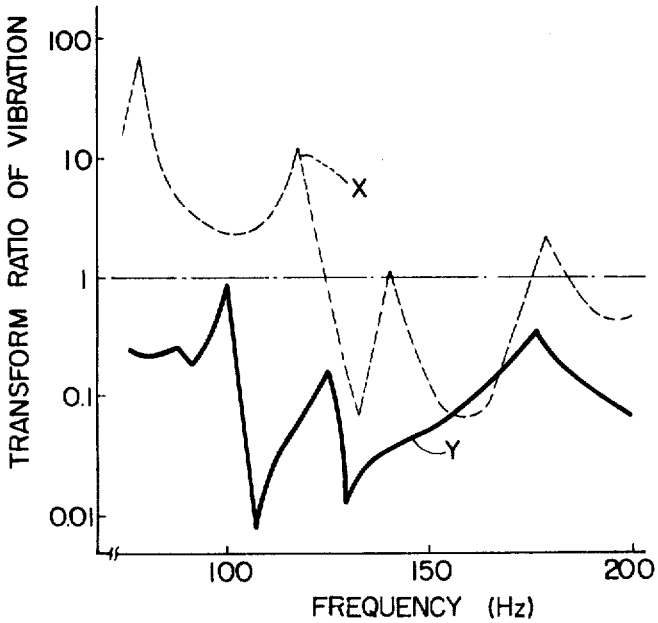
FIG. 4 is a graph for explaining the effect of this invention.

FIG. 4 has been obtained by actually measuring the effect of the example described above, and illustrates the variations of the transform ratio of vibration versus the vibration frequency. In the measurement, coils (not shown) for sensing vibrations were respectively installed on substantially central parts of the reinforcing channel 3 and the sound insulation panel 12. The ratio between the magnitude of signals which were provided from the two sensor coils was taken as the transform ratio of vibration. Further, equal spring constants were set for the prior art and the present example assessed. As shown in FIG. 4, in a frequency band of electromagnetic vibrations ranging from 100 Hz to 200 Hz, the prior art exhibited a transform ratio of vibration as great as 10 (ten) times as indicated by curve X, whereas according to the present example the transform ratio of vibration was at most 1 (one) times as indicated by curve Y, in other words, the vibration of the sound insulation panel 12 became the same magnitude as that of the vibration of the reinforcing channel 3 at the maximum of the former vibration. In this manner, the invention is greatly effective.

Figure 5:
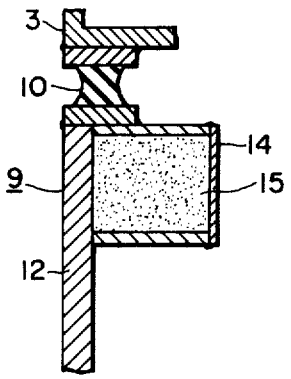
FIG. 5 is a fragmentary sectional view showing another embodiment of this invention.

FIG. 5 shows another example of this invention. In the example, cement 15 crammed in an empty box 14 is used as the looped weight beam. As compared with the looped weight beam in FIG. 3, accordingly, the looped weight beam in the present example is somewhat larger in volume, but it is more advantageous in point of cost.

Figure 6:
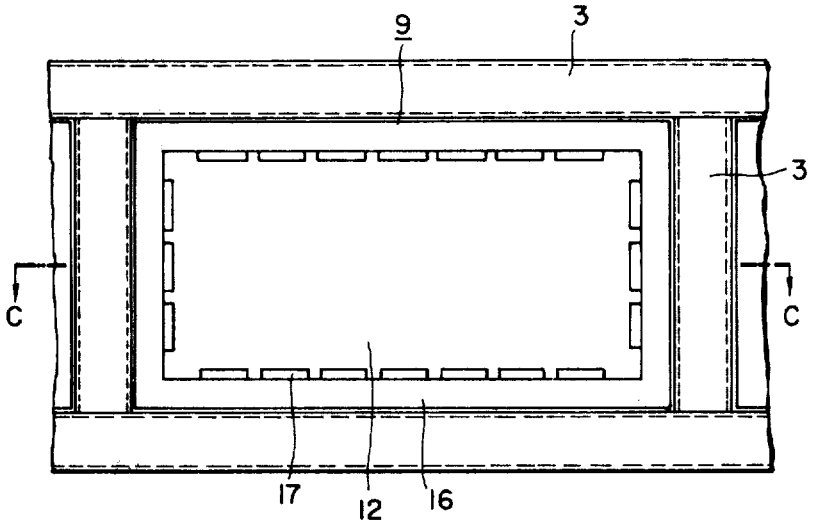
FIGS. 6 and 7 are a schematic side view and a sectional view taken along C—C in FIG. 6, respectively, showing still another embodiment of this invention.
Figure 7:
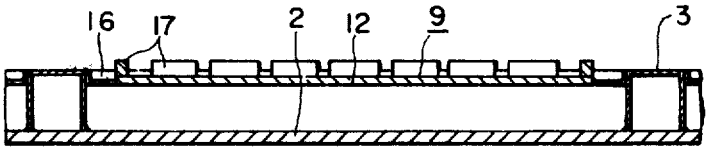

FIGS. 6 and 7 show still another example of this invention. In the example, a plate spring 16 is employed as the elastic body, and a weight beam divided into a plurality of blocks, 17 is employed as the looped weight beam. The blocks constituting the divided weight beam 17 are mounted on the outer peripheral edge of the outside surface of the sound insulation panel 12 in a manner to be uniformly distributed. Accordingly, this example achieves a sound insulating effect similar to those of the foregoing examples.

As the elastic body, any of a coiled spring, a metal bellows, etc. can also be employed.

As set forth above, according to this invention, owing to the effect of the looped weight beam disposed in the vicinity of that part of the sound insulation panel on which the elastic body is mounted, the vibration which is transmitted from the reinforcing channel to the sound insulation panel can be sharply weakened to reduce the noise even when the elastic body having a spring constant within a practical range is used.

We claim:

1. A static induction apparatus having:

(a) an oil tank which receives therein a main device of the static induction apparatus, (b) a plurality of reinforcing channels which are disposed on a side plate of the oil tank, and (c) a sound insulation panel which is carried on the reinforcing channels by a respective elastic body which is mounted to the periphery of the panel, characterized by comprising:

(d) a looped weight beam which is disposed only near the periphery of said sound insulation panel to which each elastic body is mounted so that the portion of said panel near the periphery is made greater in weight than the weight of the remaining portion of said sound insulation panel located centrally thereof.

2. A static induction apparatus having:

(a) an oil tank which receives therein a main device of the static induction apparatus, (b) a plurality of reinforcing channels which are disposed on a side plate of the oil tank, and (c) a sound insulation panel which is carried on the reinforcing channels by a respective elastic body which is mounted to the periphery of the panel, characterized in that:

a weight of a portion of said sound insulation panel to which vibration is first transmitted, said portion being the periphery of said sound insulation panel on which each elastic body is mounted, is made greater than a weight of the remaining portion of said sound insulation panel located centrally thereof.

3. A static induction apparatus according to claim 1, wherein said looped weight beam is disposed in a manner to extend near the whole part of said sound insulation panel on which said elastic body is mounted.

4. A static induction apparatus according to claim 1, wherein said looped weight beam is divided.

5. A static induction apparatus according to claim 1, wherein said looped weight beam is divided into a plurality of blocks, and said blocks are arranged substantially uniformly along said part on which said elastic body is mounted.

6. A static induction apparatus according to claim 2, wherein said weight of said portion near that part of said sound insulation panel on which said elastic body is mounted is greater in any point of said portion than said weight of said central portion of said sound insulation panel.

7. A static induction apparatus according to claim 2, wherein said weight of said portion near that part of said sound insulation panel on which said elastic body is mounted is greater in points of said portion than said weight of said central portion of said sound insulation panel.

8. A static induction apparatus according to claim 2, wherein said weight of said portion near that part of said sound insulation panel on which said elastic body is mounted is greater in points of said portion and at substantially predetermined intervals than said weight of said central portion of said sound insulation panel.

9. A static induction apparatus according to claim 1 or 2, wherein each said elastic body is interposed between said side plate and said sound insulation panel.

10. A static induction apparatus according to claim 1 or 2, wherein each said elastic body is a plate spring.

11. A static induction apparatus according to claim 9, wherein said reinforcing channels are interposed between each respective elastic body and said side plate.

12. A static induction apparatus according to claim 1, wherein said weight beam comprises a continuous beam-like additional mass mounted on an outer peripheral edge of the sound insulation panel.

13. A static induction apparatus according to claim 2, wherein said portion of the sound insulation panel which is made greater in weight extends continuously about a peripheral edge of the sound insulation panel.

* * * * *